United States Patent [19]

Baird

[11] 4,078,275

[45] Mar. 14, 1978

[54] VERNIER-ADJUSTMENT MEANS FOR VACUUM SWEEPERS HAVING STEP-ADJUSTABLE NOZZLE HEIGHT

[76] Inventor: Thomas E. Baird, 2132 N. 24th St., Springfield, Ill. 62702

[21] Appl. No.: 739,326

[22] Filed: Nov. 5, 1976

[51] Int. Cl.[2] ..... A47L 5/34

[52] U.S. Cl. ..... 15/354

[58] Field of Search ..... 15/354, 356, 355

[56] References Cited

U.S. PATENT DOCUMENTS

| | | | |
|---|---|---|---|
| 1,081,340 | 12/1913 | Spangler | 15/355 |
| 2,079,293 | 1/1937 | Kirby | 15/356 X |
| 2,172,911 | 9/1939 | Kirby | 15/354 X |

*Primary Examiner*—Christopher K. Moore
*Attorney, Agent, or Firm*—Ralph F. Staubly

[57] ABSTRACT

An upright-type vacuum sweeper has a motor-driven fan in a housing supported by a pair of front wheels on an axle which is vertically adjustable to vary the nozzle height relatively to a floor surface. A ratchet member having two parallel arcuate sets of teeth constitutes in part a lever for effecting the relative movement. A foot-depressible spring-returnable vertically disposed plunger carries a pawl-type escapement element which reciprocates between the sets of teeth to permit stepwise lowering by gravity of the housing and thus the sweeper nozzle. A foot-depressible ratchet-swinging lever provides one-stroke elevation of the housing. Novelly an adjustable screw is positioned to limit downward movement of the housing to provide a vernier adjustment in the low end of the nozzle-adjustment range to facilitate pushing the sweeper, especially over short-nap floor coverings which have been found to produce bothersome frictional resistance to sweeper movement.

2 Claims, 3 Drawing Figures

Fig. 1
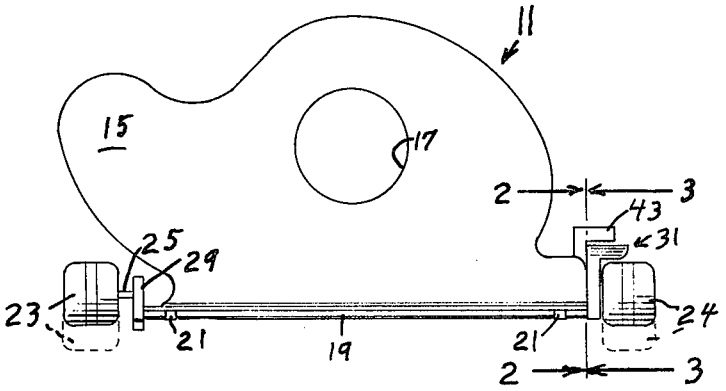
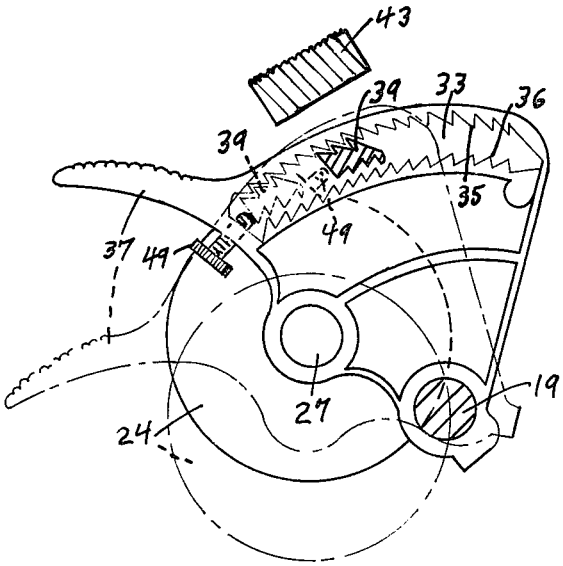
Fig. 2
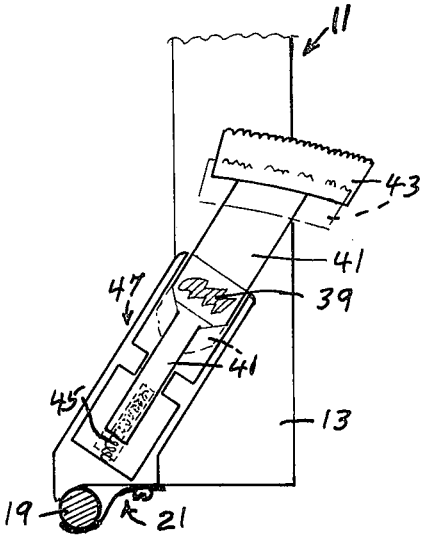
Fig. 3

VERNIER-ADJUSTMENT MEANS FOR VACUUM SWEEPERS HAVING STEP-ADJUSTABLE NOZZLE HEIGHT

BACKGROUND AND OBJECTS OF THE INVENTION

Upright vacuum sweepers employing foot-operated nozzle-height adjustment by the step-by-step type of mechanism hereindisclosed (and which the present invention is designed to improve) have enjoyed wide commercial acceptance because of their quick and easy adjustability. However, it has been found that for some floor coverings, especially the short-nap cement-down types, a finer adjustment is needed between certain steps to avoid nozzle heights that either are too low and produce difficult pushing, or are too high and cause inefficient cleaning.

It is accordingly the principal object of the present invention to provide a simple and highly effective means for effecting vernier nozzle-height adjustability between certain steps (especially the lower one or several) of a stepwise adjustable vacuum cleaner. Other objects and advantages will become apparent as the following description proceeds.

BRIEF DESCRIPTION OF THE DRAWINGS

FIG. 1 is an elevational view of the front casting of a known form of upright vacuum sweeper.

FIG. 2 is an enlarged elevational view in section on the line 2—2 of FIG. 1.

FIG. 3 is an enlarged elevational view in section on the line 3—3 of FIG. 1.

DETAILED DESCRIPTION

With reference now to the drawings, the numeral 11 generally designates that part of a known form of sweeper to which the present invention has been added. Part 11 comprises a front housing casting 13 having a rearwardly curved air-discharging extension 15, a suction intake aperture 17, and a supporting shaft 19 fixed thereto by screw-attached bearing clips 21.

The casting 19, and thereby the nozzle (not shown), are height-adjustably supported by a pair of front wheels 23 and 24 co-axially mounted on short shafts 25 and 27 (FIGS. 1 and 2). The shaft 25 is fixed to a short arm or link 29 carried by the left end of the casting-supporting rotatable shaft 19. The other (right) end of the shaft 19 has fixed thereto a ratchet member 31 (next to be described).

The ratchet member 31 (FIG. 2) carries the short shaft 27 for the wheel 24, and by controlling rotation of the shaft 19 adjusts nozzle height by moving the two wheels between their several adjusted positions shown in full and phantom lines in FIGS. 1 and 2. The ratchet member 31, like the arm or link 29, pivots about the axis of the shaft 19 to which its is also fixed, and it has cast therein an arcuate groove 33 having two parallel sets of teeth 35 and 36 circularly curved about the axis of the shaft 19. The member 31 has a foot-depressible pedal extension 37 for raising the housing 13 in a single stroke to extreme or intermediate height adjustment, since the shape of the teeth 35 and 36 permits them to cam past a combined pawl and escapement element 39 (FIGS. 2 and 3) next to be described.

The pawl-escapement element 39 is cast integrally with a plunger 41 which has a foot-depressible pedal 43 and a plunger-raising spring 45. The plunger 41 is slidably guided in a openfaced guide chamber 47 cast integrally with the casting 13. The ratchet member 31 closes the open face of the chamber 47 when it is assembled thereagainst.

Each downward stroke of the plunger 41 permits the escapement-pawl 39 to move from teeth 35 to teeth 36 for a step-by-step lowering (by the weight of the sweeper) of the housing 11 and its nozzle (not shown).

The essential and novel feature of the present invention resides in the provision of a vernier-height-adjustment means, herein disclosed specifically as being a screw 49. The screw 49 has a non-circular, serrated and/or kerfed or socketed head and is received in a tapped bore in the member 31. The screw is aligned to engaged the end of the pawl-escapement element 39 as the latter approaches the end of the relative movement between it and the swinging ratchet member 31. In FIG. 2, for clarity, the ratchet member 31 is shown in full lines in an intermediateheight position, but the relative positions of the screw end and the escapement-pawl are indicated by their phantom-shown positions, in which lowering of the housing 13 is finely adjustably arrested short of its extreme degree.

The invention having thus been described, what is claimed as new and patentable is:

1. In an upright vacuum cleaner having a casing, a motor-driven suction fan in said casing, a suction nozzle projecting forwardly and downwardly from said casing, fore and aft wheels supporting said casing, said fore wheels having a common axis, a multiple-step ratchet means for stepwise lowering said casing and thereby said nozzle relatively to said axis and thus relatively to a surface to be vacuum-cleaned, said ratchet means including a ratchet member, and an escapement-type pawl element mounted on a foot-depressible spring-lifted plunger, the improvement comprising: a vernier-type adjustment means for stopping relative movement between said ratchet member and said pawl element adjacent the low end of the nozzle-adjustment range for providing fine adjustment between said ratchet member and said pawl element, whereby fine adjustment of nozzle-to-surface frictional drag can be effected for facilitating and improving vacuum-cleaning of short-nap floor-covering materials.

2. Structure according to claim 1, said vernier-type adjustment means being an axially adjustable screw lying longitudinally of and in the path of the relative movement between said ratchet member and said pawl element.

* * * * *